United States Patent [19]

Bennison

[11] Patent Number: 4,725,184

[45] Date of Patent: Feb. 16, 1988

[54] BAG SLITTING AND EMPTYING MACHINE

[75] Inventor: Stewart Bennison, Chesterfield, England

[73] Assignee: Sac-A-Pal Limited, Sheffield, England

[21] Appl. No.: 852,143

[22] Filed: Apr. 15, 1986

[30] Foreign Application Priority Data

Apr. 16, 1985 [GB] United Kingdom ..... 8509670

[51] Int. Cl.[4] ..... B65B 69/00; B65G 65/04

[52] U.S. Cl. ..... 414/412; 53/381 R

[58] Field of Search ..... 53/381 R, 492; 83/425.2, 435.2; 414/411, 412

[56] References Cited

U.S. PATENT DOCUMENTS

| | | | |
|---|---|---|---|
| 3,664,530 | 5/1972 | Takiguchi | 414/412 |
| 4,182,592 | 1/1980 | Henryson | 414/412 |
| 4,504,183 | 3/1985 | Bennison et al. | 414/412 |
| 4,543,029 | 9/1985 | Grun et al. | 414/412 |

FOREIGN PATENT DOCUMENTS

| | | | |
|---|---|---|---|
| 1040458 | 10/1958 | Fed. Rep. of Germany | 414/412 |
| 1315853 | 5/1973 | United Kingdom | 414/412 |
| 2060545 | 5/1981 | United Kingdom | 414/412 |
| 2099390 | 12/1982 | United Kingdom | 414/412 |

*Primary Examiner*—Robert L. Spruill
*Assistant Examiner*—Donald R. Studebaker
*Attorney, Agent, or Firm*—Trexler, Bushnell, Giangiorgi & Blackstone, Ltd.

[57] ABSTRACT

A bag slitting and emptying machine comprises a bag feed conveyor (1) including at least one rotatable element (29–32) drivable in a first, bag-feeding direction; a pair of co-operating, drivable bag slitting blades (2,3) so disposed with respect to the feed conveyor (1) that a bag (B) is conveyed by the feed conveyor (1) to and through a gap presented by displacement of the slitting blades (2, 3), so that, in use, a bag (B) is slit into an upper bag part (38) and a lower bag part (39), with the two parts (38, 39) connected together at a trailing end (37) of the bag (B); and a bag infeed nip (41) defined between a discharge end of the feed conveyor (1) and rotary means (40) rotatable in a direction opposite to that of the rotatable element (29–32) of the feed conveyor (1), and serving firstly to separate the upper bag part (38) from the lower bag part (39), to expose the bag contents, and secondly to drive the slit bag (B) downwardly from the discharge end of the feed conveyor (1).

22 Claims, 7 Drawing Figures

BAG SLITTING AND EMPTYING MACHINE

This invention relates to a machine for the slitting and emptying of bags of contents such as asbestos, cement, grain etc.

Known machines are described in GB No. 1315853, GB No. 2060545, GB No. 2092980 and U.S. Pat. No. 3,853,235, and present a horizontally moving bag to a pair of rotary slitting blades, usually mounted on swing arms, to slit the bag from a leading bag end, towards a trailing bag end, with slitting being halted before the trailing end is reached, the resulting upper bag part being separated from the resulting lower bag part so that the contents can be emptied through a grid etc., with the empty bag then conveyed to a disposal system.

The object of the present invention is to provide a bag slitting and emptying machine that can be produced for considerably reduced cost compared with prior art proposals, and can be operated and maintained at similarly reduced costs.

According to a first aspect of the present invention there is provided a bag slitting and emptying machine comprising a bag feed conveyor including at least one rotatable element drivable in a first, bag-feeding direction; a pair of co-operating, drivable bag slitting blades so disposed with respect to the feed conveyor that a bag is conveyed by the feed conveyor to and through a gap presented by displacement of the slitting blades, so that, in use, a bag is slit into an upper bag part and a lower bag part, with the two parts connected together at a trailing end of the bag; and a bag infeed nip defined between a discharge end of the feed conveyor and rotary means rotatable in a direction opposite to that of the rotatable element of the feed conveyor, and serving firstly to separate the upper bag part from the lower bag part, to expose the bag contents, and secondly to drive the slit bag downwardly from the discharge end of the feed conveyor.

Preferably, the feed conveyor has an endless conveying element. Thus, in a first embodiment, the endless conveying element is a belt, the conveyor comprising rotatable elements in the form of a first roller at a loading end of the conveyor and a second, return roller at a discharge end of the conveyor. Either or both rollers may be drivable, while any required number of idler rollers may be located between the first and second rollers to support the conveying run of the belt. In a second embodiment, the endless conveying element is constituted by chains, specifically a pair of spaced-apart, endless drive chains carrying transverse, bag-supporting slats, which may have an upwardly projecting edge to engage the underside of a bag, and specifically the underside of a lower bag part, to provide a series of high pressure points at the nip. Irrespective of its particular form, the feed conveyor preferably extends horizontally, so that after leaving the discharge end of the conveyor, gravity assists the downward movement of a leading, transverse edge of the lower bag part into the nip. The nip may be continuous or discontinuous, both axially and circumferentially by appropriate configuration of the rotary means adjacent the discharge end of the conveyor, whilst the rotary means may be rotatable at a higher speed than the rotary element(s) of the feed conveyor. Thus, this rotary means may be constituted by a single roller extending transversely of the machine, or a plurality of co-axial rollers, whilst the periphery of the roller(s) may be plain or may comprise a plurality of radially projecting beater flaps rotatable, with their roller(s), in a direction opposite to that of the adjacent return roller of the conveyor. In detail, the flaps e.g., four spaced 90° apart, may extend generally radially from their roller(s), which is spaced from the conveyor belt by a plurality of discs, preferably freely rotatable, and co-axially mounted on the roller in a longitudinally spaced-apart manner, being spring loaded against the conveyor belt as the latter passes around the return roller. In another embodiment, the rotary separating and driving means may additionally be provided with a secondary conveyor—constituting a separating and driving conveyor—preferably comprising a plurality of spaced-apart, endless conveying bands, and consequently incorporating a return roller at a return end of the secondary conveyor, with the bag contents, if granular, being capable of falling through the gaps between the bands. The secondary conveyor may be provided with a support structure which is spring loaded towards the discharge end of the feed conveyor, so that a lower bag part is gripped in the vicinity of that end between the conveying element of the feed conveyor and the secondary conveyor. Instead of the support structure of the secondary conveyor being spring loaded, the endless conveyor elements of the secondary conveyor may be elastically deformable. Preferably however, the secondary conveyor extends at least partially beneath the feed conveyor, so that the bag gripping action is effective along a portion of the underside or return run of the feed conveyor. The loading end of the feed conveyor may be preceded by a loading conveyor e.g., of the endless belt type, which loading conveyor serves firstly to distance a machine operator loading bags into the machine from the slitting blades (which are preferably mounted on swing arms that could be mounted on slides), and secondly to impart some linear speed to loaded bags before transfer from the loading conveyor to the feed conveyor.

The machine may furthermore be provided with a separator bar to separate the upper bag part from the lower bag part, and possibly to support temporarily the upper bag part, as the bag is advanced by the feed conveyor. The presence of a separater bar is to some extent dependent on the nature of the bag contents, and in particular whether the contents are flowable (e.g. by being a granular or powdered product and hence being penetrable by the separater bar) or solid (e.g. by being pressure packed such as asbestos). If provided, the separater bar extends transversely of the machine and is preferably height adjustable with respect to the conveyor. The separater bar is conveniently carried by a pair of support arms attached to a transversely extending, mounting shaft.

If the bag contents are flowable, then the machine is preferably provided with a screening means, through which the contents may fall, but through which the slit bags may not pass. In detail, the screening means may be constructed from a plurality of (e.g., four, parallel, spaced apart) bars serving principally for bag guidance purposes and formed with a trash screen or mesh located beneath the bars, to a unitary structure. The bars may in one embodiment consist of upper and lower sets of bars disposed at an obtuse angle with respect to one another. The unitary structure may be supported at or towards a lower end thereof on flexible suspension mountings. The screening means may be rendered self-cleaning by being inclined, so that bags collected by the screen fall down the latter to be discharged at an open, discharge edge. Self-cleaning may be enhanced by vibrating the unitary structure. This may be readily achieved from the hub of the separating means, by mounting eccentric cranks on the hub, and attaching the cranks to the unitary structure.

Beyond the discharge edge of the screening means a screw auger is preferably provided, serving to collect emptied, or substantially emptied, bags falling from the discharge edge of the screening means, and to agitate (to remove any remaining contents) and compact emptied bags. The lowermost segment e.g., 180°, of the auger may itself be surrounded by a screen to allow any bag contents discharged by the auger to fall, with the bulk of the contents, to and through a discharge chute or outlet hopper disposed beneath both the unitary structure and the auger. Conveniently, the feed of emptied, or substantially emptied, bags to the screw auger is to an upper part thereof, and preferably the screw auger is located beneath a portion of the feed conveyor. This last mentioned feature provides the possibility of providing the feed conveyor with additional, endless conveying bands which can be deflected beneath the feed conveyor to form, with a portion of the secondary conveyor, a bag-driving guide route or throat for positively ensuring infeed of emptied bags to the screw auger. Such additional endless conveying bands may be of circular section material. Furthermore, a rotary brush device may be provided in advance of the screw auger for brushing out any content still adhering to the inside of a slit bag, which brush device is conveniently driven from the secondary conveyor drive.

According to a second aspect of the invention, a feature of independent significance is that the screening means is constituted by a rotatable mesh cage, to tumble and agitate the bags, to discharge the bulk of the contents therefrom, with an outlet end of the cage discharging emptied, or substantially emptied bags.

According to a third aspect of the invention there is provided a bag slitting and emptying machine comprising a bag feed conveyor; a pair of co-operating, drivable bag slitting blades, mounted on swing arms and so disposed with respect to the feed conveyor that a bag is conveyed by the feed conveyor to and through a gap presented by displacement of the slitting blades, so that, in use, a bag is slit into an upper bag part and a lower bag part, with the two parts connected together at a trailing end of the bag; and a rotatable mesh cage located downstream of the feed conveyor and having an inlet end located adjacent a discharge end of the feed conveyor, to receive slit bags therefrom, with an outlet end of the cage discharging emptied, or substantially emptied, bags.

Preferably, discharge from the cage of the machine in accordance with the second and third aspects is to a screw auger, while enhanced discharge of the bag contents may be achieved if the bags are slit completely to provide two unattached bag parts.

According to a fourth aspect of the invention, there is provided a bag slitting and emptying machine comprises a lifting means for a palletized load of bags to be slit, means to feed bags individually to at least two slitting blades, a rotatable mesh drum located beyond the blades to receive slit bags, and being provided with a bag displacing helix or spiral and serving to convey bags to an open end of a rotating mesh cage to tumble the slit bags to remove their contents.

Preferably, the lifting means is tiltable, so that bags may be fed by gravity to the slitting blades. It is also preferred for the lifting means to incorporate a scissor type lifting device, so that layers of bags may be progressively elevated for individual feeding to the slitting blades. It is also preferred for the entire machine, of whatever specific form, to be totally enclosed in a casing, both for reasons of operator safety and dust control.

The invention will now be described in greater detail, by way of examples, with reference to the accompanying drawings in which.

Figure 1:
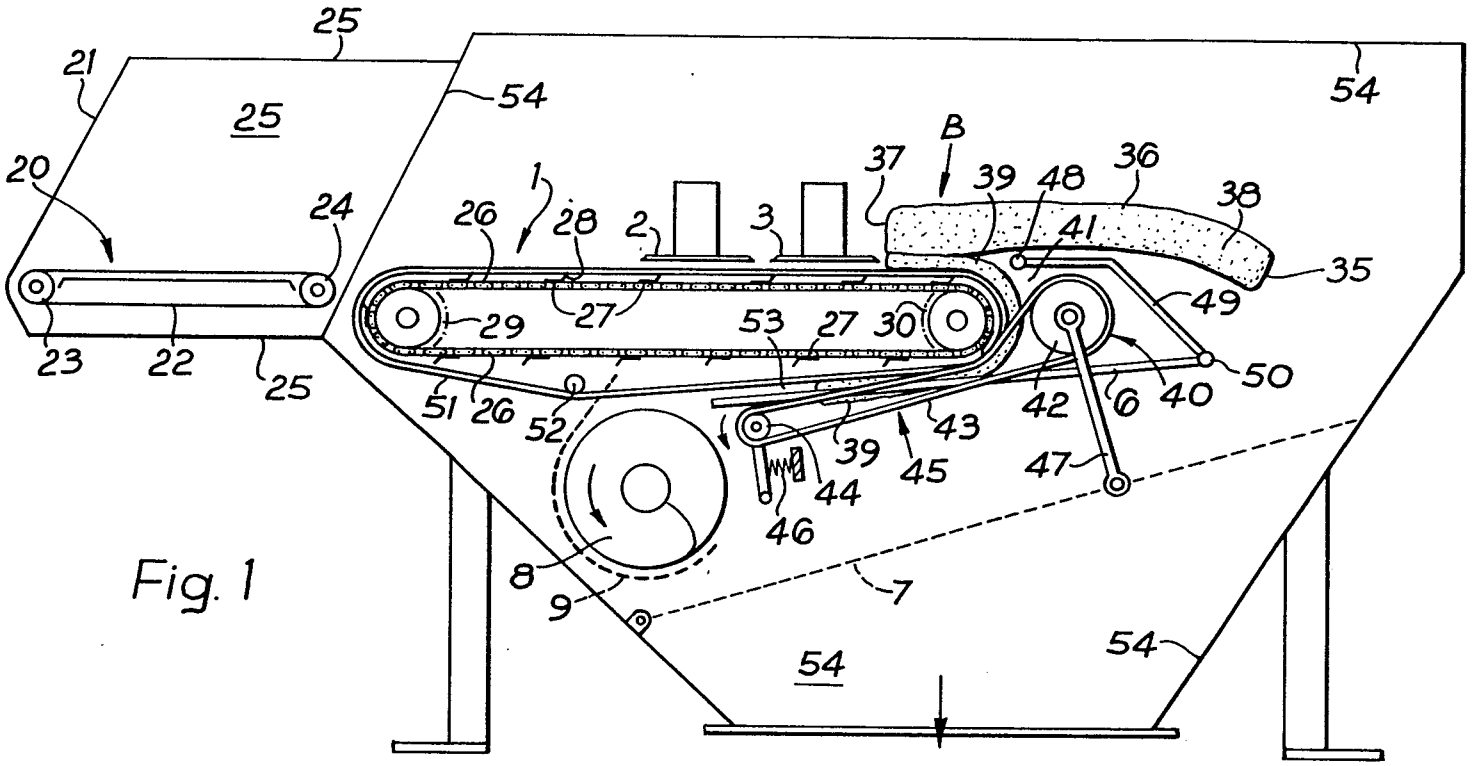
FIG. 1 is a side elevation of a first embodiment of machine.
Figure 2:
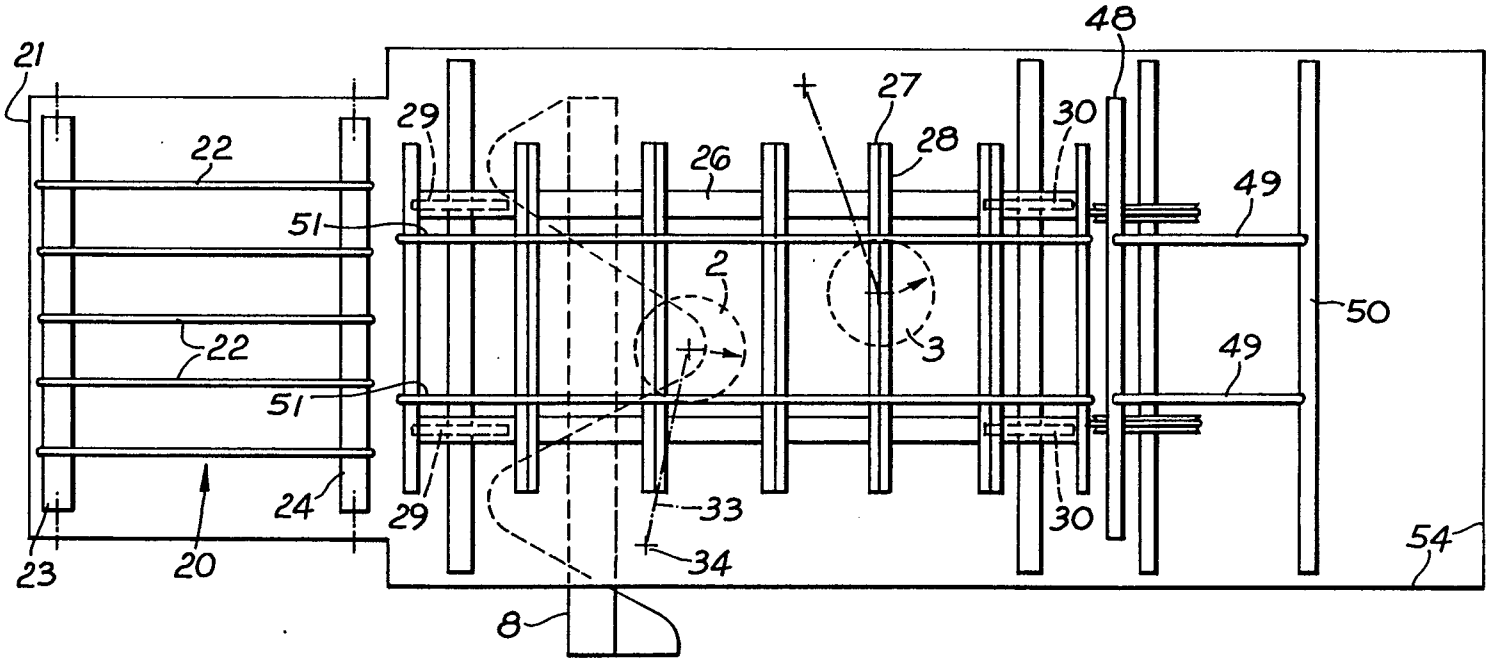
FIG. 2 is a plan view of the machine of FIG. 1.
Figure 3:
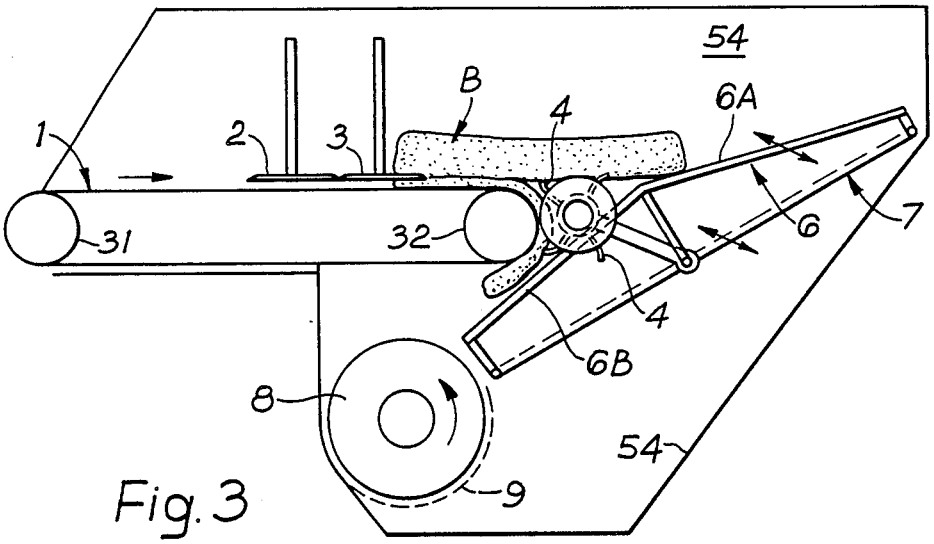
Figure 4:
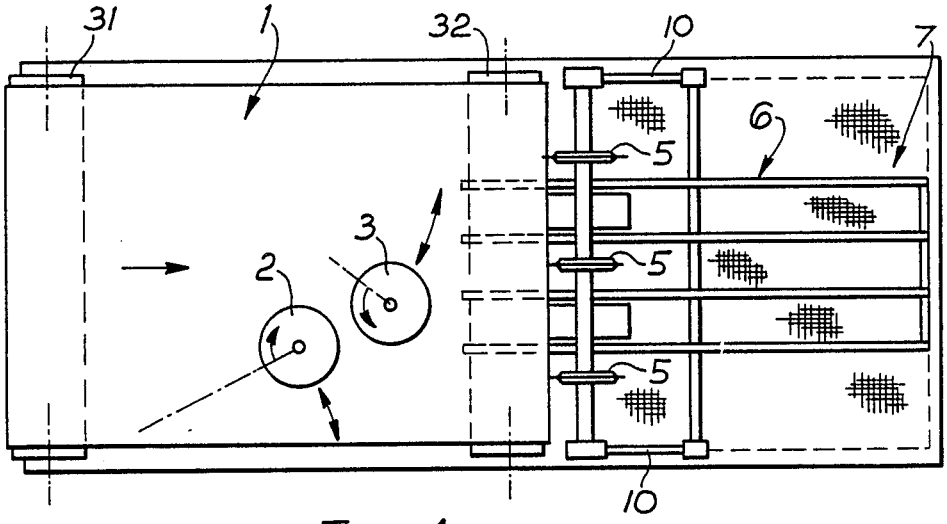
Figure 5:
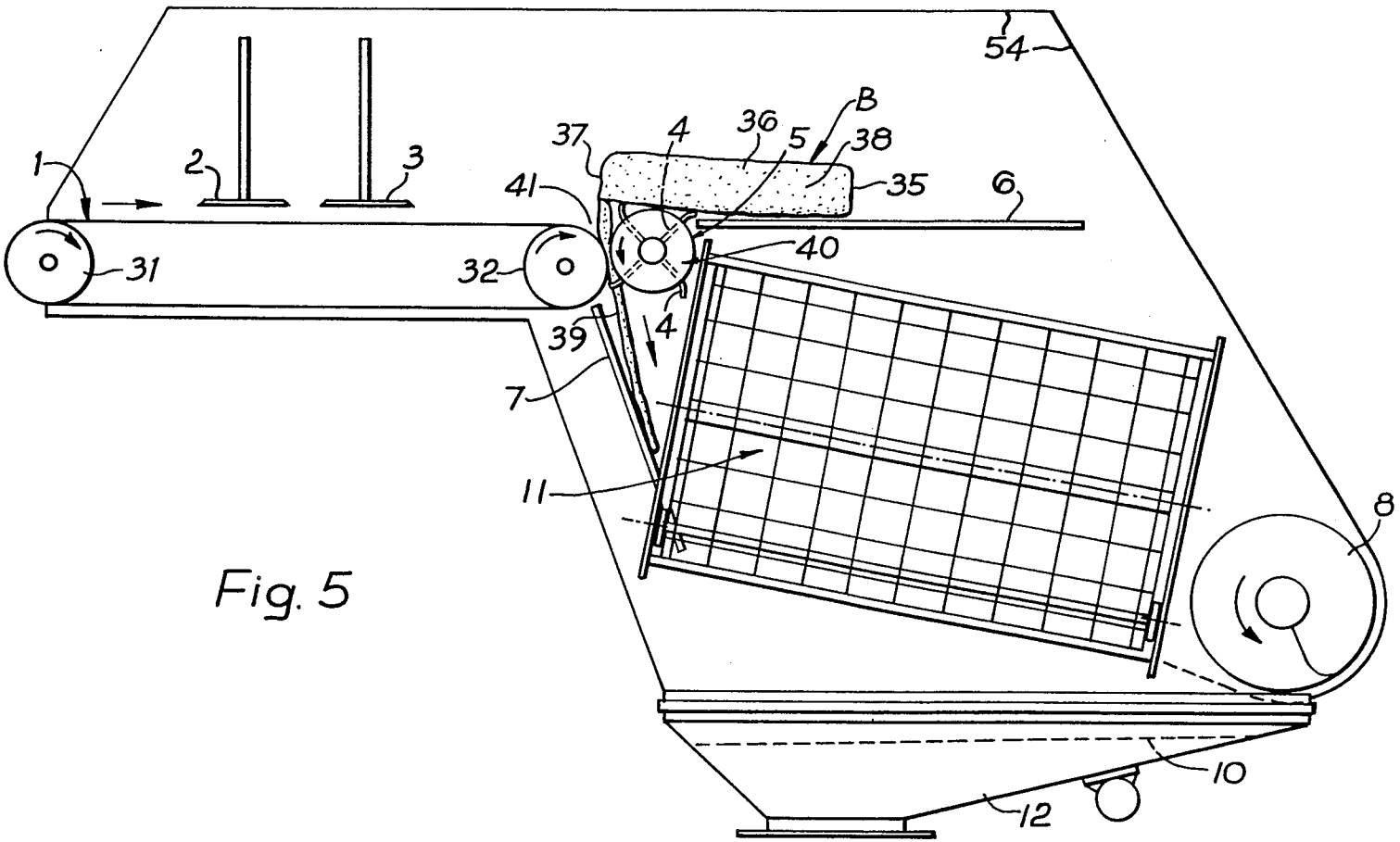
Figure 6:
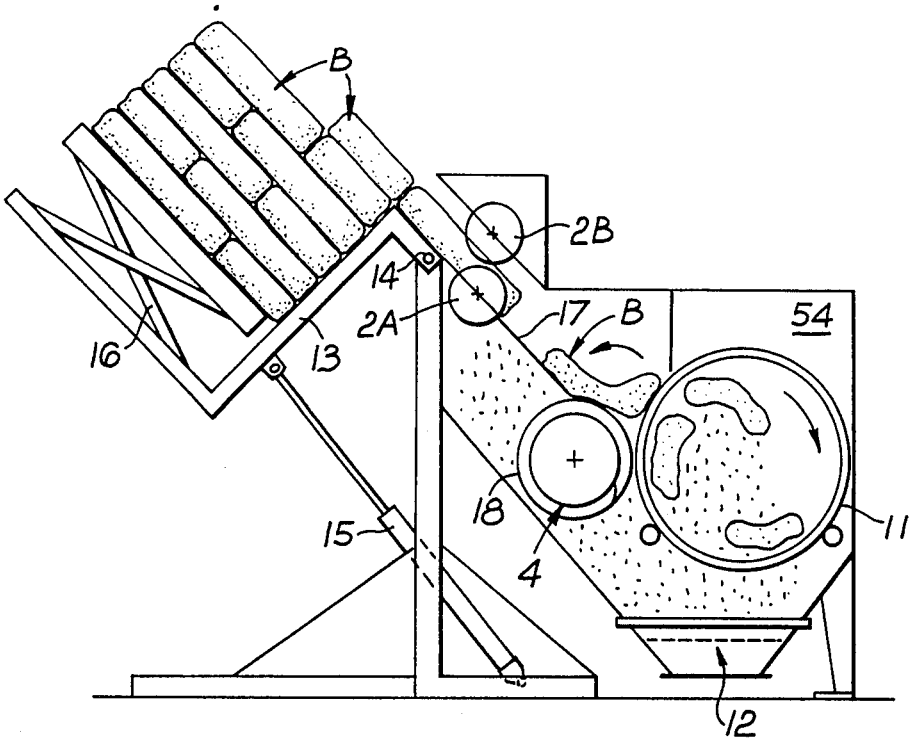

FIG. 3 corresponds to FIG. 1 but shows a second embodiment;

FIG. 4 corresponds to FIG. 2 but shows the second embodiment;

FIG. 5 corresponds to FIG. 1 but shows the third embodiment;

FIG. 6 corresponds to FIG. 1 but shows the fourth embodiment; and

Figure 7:
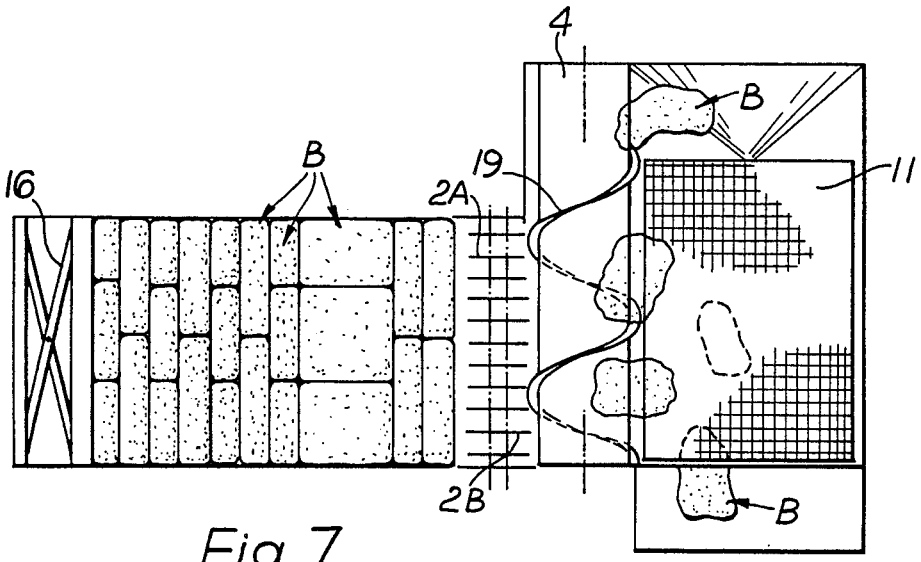

FIG. 7 corresponds to FIG. 2 but shows the fourth embodiment.

In all the figures, like reference numerals are used for like components.

A bag B is loaded by any convenient means (manually or automatically) onto a loading conveyor 20 having an inlet door 21 and comprising endless belts 22 extending between drive and return rollers 23, 24, the loading conveyor 20 being enclosed within a casing 25. From the loading conveyor 20, a bag B passes to a feed conveyor 1. In the embodiment of FIGS. 1 and 2, the feed conveyor 1 is a chain conveyor, comprising a pair of spaced apart, endless drive chains 26 carrying transverse, bag supporting slats 27 each having an upwardly projecting edge 28 to engage the underside of a bag, with a pair of drive sprockets 29 provided at a loading end of the feed conveyor 1, and a pair of drive sprockets 30 provided at a discharge end of the feed conveyor 1. In the embodiments of FIGS. 1 and 2, the feed conveyor 1 is also provided with a plurality of endless conveying bands 51, with a deflection roller 52.

In the embodiments of FIGS. 3 to 5 the feed conveyor 1 is in the form of a belt conveyor, having a roller 31 at its loading end and a roller 32 at its discharge end.

Irrespective of its form, the feed conveyor 1 is usually driven at a higher linear speed than the loading conveyor 20, and eventually a bag B is brought into contact with a leading rotary knife blade 2, which is spring loaded towards the longitudinal centre line of the conveyor 1 by being supported, in a known manner, on a swing arm indicated by chain dotted line 33, for oscillation about axis 34. As the bag B is advanced by the feed conveyor 1 the swing arm of the blade 2 is displaced sideways, and in doing so cuts the bag B along leading bag end 35 and then along the bag side 36, while a trailing rotary knife blade 3, similarly supported on a swing arm, enters the same cut as the leading blade 2 and similarly follows the bag profile across the leading bag end 35 and down the other bag side, the progression of the bag B by the feed conveyor 1 and the arcuate movement of the blades 2 and 3 resulting in the trailing bag end 37 remaining unslit and consequently an upper bag part 38 remaining attached to a lower bag part 39 across the trailing end. As indicated in FIGS. 1, 3 and 5, a rotary means 40, together with the discharge end of the feed conveyor 1, defines a nip 41 through which initially the lower bag part 39 is forced, downwardly, by the rotary means 40, and subsequently the upper bag part 38. In the embodiment of FIGS. 1 and 2 the rotary means 40 comprises a roller 42 and a plurality of endless conveying bands 43 passing around the roller 42 and also around a return roller 44, so as to constitute a secondary conveyor 45, having a support structure which is spring mounted on spring means 46 and vibrated/oscillated by an eccentric means 47. The secondary conveyor 45 extends at least partially beneath the feed conveyor 1, to define a bag-driving guide route or throat 53 so that the bag gripping action, which is illustrated in FIG. 1 as having already commenced on the lower bag part 39, is effective along a portion of the underside of the feed conveyor 1. Above the nip 41 is provided a transversely extending separator bar 48 to separate the upper bag part 38 from the lower bag part 39 and, as illustrated in FIG. 1, to support temporarily the upper bag part 38, the separator bar 48 being carried by a pair of support arms 49 attached to a transversely extending mounting shaft 50.

In the embodiments of FIGS. 3 to 5, the rotary means 40 comprises a plurality of beater flaps 4 carried by a reduced diameter roller, while spacer discs 5 are also co-axially mounted on the reduced diameter roller. If, as would frequently be the case, the bag contents are flowable, the machine would be provided with a grid 6, comprising a plurality of grid bars, through which the contents may pass, but through which the bags may not pass. In the embodiment of FIGS. 1 and 2 the grid 6 is provided beneath the nip 41, whilst in the embodiments of FIGS. 3 to 5 the grid 6 comprises an upper set of bars 6A and a lower set of bars 6B, whereby the upper bag part 38, under the influence of the drive imparted to the bag B by the conveyor 1, is projected out on to the upper set of bars 6A. Eventually the upper bag part is fed into and through the nip 41 and onto the lower set of bars 6B.

Beyond the grid 6, which is preferably inclined, is located a screw auger 8 to which the then emptied bag is fed for any finaly emptying and for compaction and discharge into a container, the lower segment of the auger 8 being surrounded by a feedback screen 9. Beneath the grid 6 is a trash screen 7 which, in the embodiments of FIGS. 3 to 5 is formed to a unitary structure, which, as indicated previously, has a flexible suspension mounting at a lower end and the structure being vibrated by means of connecting rods 10 with eccentric cranks, which are connected to the hub.

In the embodiment of FIG. 5, the slitting operation is as described with reference to FIGS. 1 and 4, but the bags B are fed into a rotating mesh cage 11 to tumble and agitate the bags and to achieve complete, or substantially complete emptying of their contents. The cage 11 is rotatable about an inclined axis and has an elevated inlet end and a lower outlet end which discharges empty bags into a screw auger 8 serving, as with the previous embodiments, to agitate the bags to remove any remaining contents and to collect and compact emptied bags. Beneath the cage 11 and auger 8 is located a vibratory bottom outlet hopper 12, which is also provided with a trash screen.

Instead of using a rotary means 40, slit bags could be fed directly into the cage 11, and with this arrangement, bag emptying would be enhanced if the blades 2 and 3 were arranged to cut completely around the bag.

In the embodiment of FIGS. 6 and 7, a plurality of rotary knife blades 2A e.g. spaced 150 mm apart, along a drive shaft are provided, and blades 2B along a second drive shaft are, in contrast to the other embodiments, intended to produce slits in the top and bottom of the bags B. The latter are illustrated as a palletized load with a lifting means in the form of a frame 13 pivotable about axis 14 under the control of a ram 15, the frame 13 incorporating a scissor type lifting device 16. The bags B slide along a feed table 17 and initially engage a rotatable mesh drum 18 provided with a bag displacing helix or spiral 19 and serving to convey bags to an open end of a rotating mesh cage 11 serving to tumble and agitate the bags, to discharge the remainder of their contents through a bottom outlet hopper 12. As before, emptied bags pass from the cage 11 to a screw auger (not shown).

With all embodiments, the slitting blades, feed conveyor, rotary means/secondary conveyor and the screw auger are housed within a casing C, which may be provided with viewing/access windows, the casing being present for both dust control purposes and safety purposes, whilst it is also preferred for a single motor e.g. an electric motor to drive the feed conveyor, the rotary means/secondary conveyor and the screw auger.

In all embodiments, the feed conveyor 1, rotary means 40, screw auger 8 etc., are contained within a casing 54.

What I claim is:

1. A bag slitting and emptying machine comprising a bag feed conveyor including at least one rotatable element drivable in a first, bag-feeding direction; a pair of co-operating, drivable bag slitting blades disposed with respect to said feed conveyor for slitting a bag on said conveyor into an upper bag part and a lower bag part, with said two parts connected together at a trailing end of said bag; rotary means rotatable in a direction opposite to that of said rotatable element of said feed conveyor and disposed with respect to a discharge end of said feed conveyor to define a bag-pinching, infeed nip therebetween for separating said upper bag part from said lower bag part, and for driving said bag downwardly from said discharge end of said feed conveyor.

2. A machine as claimed in claim 1, wherein an endless conveying element is provided on said feed conveyor, said endless conveying element being in the form of a belt, said feed conveyor comprising a first roller at a loading end of said conveyor and a second, return roller at a discharge end of said conveyor.

3. A machine as claimed in claim 1, wherein an endless conveying element is provided on said feed conveyor, said endless conveying element being constituted by chains, and a pair of spaced-apart, endless drive chains carrying transverse, bag-supporting slats.

4. A machine as claimed in claim 1, wherein said nip is continuous axially and circumferentially.

5. A machine as claimed in claim 1, wherein said nip is discontinuous axially and circumferentially.

6. A machine as claimed in claim 1, wherein said rotary means is constituted by at least one roller extending transversely of said machine, and a periphery of said roller comprises a plurality of radially projecting beater flaps.

7. A machine as claimed in claim 1, wherein said rotary means is additionally provided with a secondary conveyor.

8. A machine as claimed in claim 7, wherein said secondary conveyor comprises a plurality of spaced-apart, endless conveying bands, with a return roller at a return end of said secondary conveyor.

9. A machine as claimed in claim 7, wherein said secondary conveyor is provided with a support structure which is spring loaded towards the discharge end of its feed conveyor.

10. A machine as claimed in claim 7, wherein said secondary conveyor extends at least partially beneath said feed conveyor.

11. A machine as claimed in claim 1, wherein said loading end of said feed conveyor is preceded by a loading conveyor.

12. A machine as claimed in claim 1, wherein said slitting blades are mounted on swing arms.

13. A machine as claimed in claim 1, provided with a separator bar to separate said upper bag part from said lower bag part.

14. A machine as claimed in claim 1, provided with a screening means through which the contents of a slit bag may fall.

15. A machine as claimed in claim 14, wherein a trash screen is provided beneath said screening means.

16. A machine as claimed in claim 15, wherein said trash screen is rendered self-cleaning by being inclined.

17. A machine as claimed in claim 16, wherein vibration is imparted to said screening means and trash screen.

18. A machine as claimed in claim 15, wherein a screw auger is provided beyond a lower, discharge end of said screening means.

19. A machine as claimed in claim 1, wherein said nip is continuous axially.

20. A machine as claimed in claim 1, wherein said nip is discontinuous axially.

21. A machine as claimed in claim 1, wherein said nip is continuous circumferentially.

22. A machine as claimed in claim 1, wherein said nip is discontinuous circumferentially.

* * * * *